United States Patent [19]

Harrigan

[11] 4,268,893

[45] May 19, 1981

[54] ILLUMINATION APPARATUS FOR USE IN AN OBSCURED AMBIENT, FLUID CONDUIT AND METHOD

[76] Inventor: Roy M. Harrigan, Bromley Mountain Rd., Manchester, Vt. 05254

[21] Appl. No.: 949,147

[22] Filed: Oct. 6, 1978

Related U.S. Application Data

[63] Continuation of Ser. No. 762,498, Jan. 26, 1977, abandoned.

[51] Int. Cl.[3] ..... F21V 33/00

[52] U.S. Cl. ..... 362/96; 362/109

[58] Field of Search ..... 362/109, 96, 114, 253, 362/171-173; 239/2; 134/172, 198, 113

[56] References Cited

U.S. PATENT DOCUMENTS

| | | | |
|---|---|---|---|
| 1,153,044 | 9/1915 | Dunham | 362/96 |
| 1,848,179 | 3/1932 | Kiester | 362/96 |
| 2,855,497 | 10/1958 | Bacon | 362/96 |
| 3,716,170 | 2/1973 | Mangels | 362/96 |
| 3,812,340 | 5/1974 | Brandt | 362/96 |

FOREIGN PATENT DOCUMENTS

| | | | |
|---|---|---|---|
| 21331 | of 1915 | United Kingdom | 239/2 |

*Primary Examiner*—Harold J. Tudor
*Assistant Examiner*—Edward F. Miles
*Attorney, Agent, or Firm*—Robert S. Smith

[57] ABSTRACT

A light assembly which includes a source of light and a reflector for directing the light in at least one direction. A fluid is directed about the light to disperse obscuring substances in the ambient surrounding the light. The fluid is directed through a conduit having a contour which minimizes turbulence.

2 Claims, 3 Drawing Figures

ILLUMINATION APPARATUS FOR USE IN AN OBSCURED AMBIENT, FLUID CONDUIT AND METHOD

This is a continuation, of application Ser. No. 762,498, filed Jan. 26, 1977, now abandoned.

BACKGROUND OF THE INVENTION

The invention relates to a method and apparatus for illumination in obscured ambients and also to the construction of fluid conduits. Various forms of the invention will have particular application to ambients having smoke such as that encountered by firemen in burning buildings. Other forms of the invention may have particular application for increasing visibility in underwater environments wherein mud or other contamination seriously restricts the visibility of a diver. Firemen and other rescue personnel have heretofore been provided with air supply for respiration for some finite time and which does not rely on the ambient air. A major limitation of the ability of firemen and rescuers to accomplish their task at fire scenes is frequently the presence of dense smoke which cannot be penetrated even with high intensity light beams. A similar problem exists where illumination is required in the presence of dust particles and in some cases heavy fog. Also, a similar problem exists in underwater work such as rescue work in muddy water, where existing high intensity light beams are reflected back or obstructed by the contamination within the water.

It is an object of the invention to provide a light assembly and method which will function in an obscured ambient.

It is another object of the invention to provide such an assembly which will improve visibility over a greater distance from the source of the illumination than was previously possible.

SUMMARY OF THE INVENTION

It has now been found that these and other objects of the invention may be satisfied by a light assembly which includes a source of light and a reflector for directing the light in at least one direction. A reservoir of fluid is provided together with means for directing the fluid in a direction parallel to the direction of the light about at least a portion of the circumference of the reflector. The means for directing in fluid will vary with the application. In one form of the apparatus the fluid conduit for directing the fluid about the circumference of the illumination source is dimensioned and configured so as to have a drag induced by fluid flow which is equal to the drag induced by the exterior of the reflector to minimize turbulence.

DETAILED DESCRIPTION OF THE PREFERRED EMBODIMENT

Figure 1:
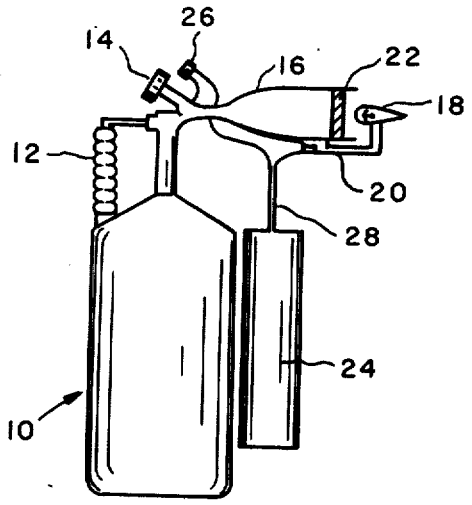
FIG. 1 is an elevational view of the apparatus in accordance with one form of the invention.

Referring now to FIG. 1 there is shown the apparatus in accordance with one form of the invention which includes a tank of fluid 10. For applications where the ambient has smoke and air mixed together, it will ordinarily be desirable to use nitrogen as the fluid although the invention contemplates not only the use of compressed gases including clean air and nitrogen as well as flourocarbons which may be held in the tank in the liquid state and allowed to expand to the gaseous state. Tank 10 includes a handle 12 and a valve 14 for selectively allowing the passage of gas out of the tank. The valve 14 is in fluid communication with an enlarged fluid conduit or diffuser 16 which in the preferred embodiment extends around the circumferential region of a reflector and light assembly 18 which is supported by bracket 20. Ordinarily the light will be of the high intensity type although the particular type of light will vary with the application involved. In some forms of the invention it may be desirable to provide vanes 22 which are used to impart a spiral motion to the fluid stream. For other applications the vanes will not be desirable or necessary. The light assembly is powered by battery pack 24 which is selectively connected to the light assembly 18 by a switch 26. Wires 28 complete the circuit between the light assembly 18 and the battery pack 24.

Figure 2:
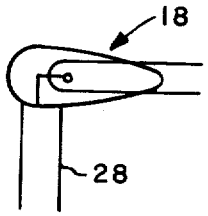
FIG. 2 is an elevational view to an enlarged scale of the light portion of the apparatus shown in FIG. 1.

For those applications where it is desirable to see in muddy water and the fluid to be used is a stream of clear water, it will be understood that ordinarily it will be necessary to supply a source of clean water through a hose rather than relying on a tank. In some application, however, it may be possible to use a reservoir of water which may be propelled by a fluorocarbon. Although ordinarily the quantity of fluid necessary to achieve the desired effect ordinarily will be too great in relation to the size of a tank which could ordinarily be carried. The light assembly 18 ordinarily will have a translucent section at least on the right hand side (as viewed, in FIGS. 1 and 2). The shape of the housing for the light assembly 18 will be chosen to minimize turbulence between the light assembly 18 and the fluid conduit 16.

Figure 3:
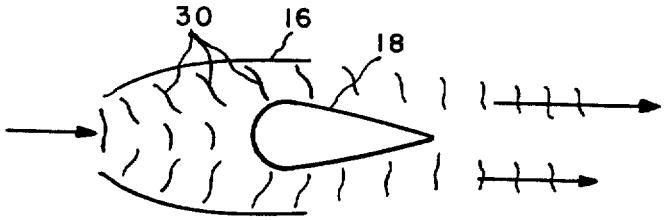
FIG. 3 is a diagrammatic view illustrating the relationship between a fluid conduit surrounding an obstruction to fluid flow such as the light.

Referring to the view of FIG. 3, fluid enters the fluid conduit 16 from the left and divides around the light assembly 18. To avoid turbulence of the fluid intermediate the light 18 and the fluid conduits 16 it is desirable that the drag produced by the fluid conduit 16 and the light assembly 18 is the same. The lines 30 represent instantaneous positions of the fluid stream as it passes around the light assembly 18. It will be seen that initially the drag in front of the light assembly 18 will be greater than the drag on the wall of fluid conduit 16 and that in the preferred embodiment the drag will be equal as the fluid conduit 16 and accordingly a minimum amount of turbulence is created.

For some applications it will be desirable that the translucent section of light assembly 18 be yellow colored. In some applications the container 10 for the fluid will not be rigidly attached to the fluid conduit 16 surrounding the light as shown in FIG. 1. More specifically for some applications the fluid conduit and light assembly may be disposed on a rescuer's helmet and the fluid source may be disposed remotely such as on the user's back with a flexible hose connecting to the fluid conduit 12. In still other applications and particularly where the apparatus is being used in underwater applications where a substantial volume of liquid will be necessary, the fluid conduit may be supplied by a long hose. It will be understood that the applications described above ordinarily have involved the use of a generally round fluid conduit with a generally round light assembly. The invention also contemplates the use of elongated light assemblies with correspondingly configured fluid conduits. The geometric relationship between the light source and the fluid stream may vary depending upon the application. For some applications it will be desirable that the light beam from the light source be directed directly into the fluid stream. In other applications it will be desirable that the light beam be disposed with the fluid stream surrounding it. For most applications it will be desirable that the fluid stream be of a relatively large volume and low velocity although for other applications higher velocity and lower volume may be desirable.

It will be understood that the reflector may be part of the envelope of an incandescent lamp such as in conventional sealed beam incandescent light assemblies or it may be a discreet member as in halogen lamps to use a small envelope to contain the gas surrounding the filament and a separate reflector.

It will be understood from the foregoing that the apparatus provides a simple and effective apparatus and method for illumination in an obscured environment which has significant application in rescuing people in burning buildings as well as performing underwater work in muddy water.

I claim:

1. A light assembly for use in an obscured environment which comprises: a source of light, a reflector for directing the light in at least one direction, and means for displacing smoke and other atmospheric contaminents which includes a reservoir for a gas and means for directing said gas in a direction parallel to said one direction about at least the majority of the circumferential extent of said reflector, said means for directing including an elongated hollow member disposed about said reflector, said elongated hollow member being dimensioned and configured at each radial point to induce a drag at the interior surface of said elongated hollow member as a result of fluid flow which is equal to the drag simultaneously induced on said reflector as a result of fluid flow whereby turbulence between said reflector and said member is minimized.

2. A light assembly for use in an obscured underwater environment which comprises: a source of light, a reflector for directing the light in at least one direction, and means for displacing water borne contaminents which includes a reservoir for a liquid and means for directing said liquid in a direction parallel to said one direction about at least the majority of the circumferential extent of said reflector, said means for directing including an elongated hollow member disposed about said reflector, said elongated hollow member being dimensioned and configured at each radial point to induce a drag at the interior surface of said elongated hollow member as a result of fluid flow which is equal to the drag simultaneously induced on said reflector as a result of fluid flow whereby turbulence between said reflector and said member is minimized.

* * * * *